US008454295B2

(12) United States Patent
Balcom

(10) Patent No.: US 8,454,295 B2
(45) Date of Patent: Jun. 4, 2013

(54) DETACHABLE BOOM APPARATUS FOR FORK TRUCKS

(76) Inventor: David E. Balcom, Grand Rapids, MI (US)

( * ) Notice: Subject to any disclaimer, the term of this patent is extended or adjusted under 35 U.S.C. 154(b) by 599 days.

(21) Appl. No.: 12/724,999

(22) Filed: Mar. 16, 2010

(65) Prior Publication Data

US 2011/0226556 A1 Sep. 22, 2011

(51) Int. Cl.
*B66F 9/18* (2006.01)

(52) U.S. Cl.
USPC ..... 414/607; 212/180

(58) Field of Classification Search
USPC ..... 414/607, 686; 212/180
See application file for complete search history.

(56) References Cited

U.S. PATENT DOCUMENTS

| | | | | |
|---|---|---|---|---|
| 68,217 | A | 8/1867 | Lewis | |
| 95,573 | A | 10/1869 | Dodge | |
| 1,460,082 | A | 6/1923 | Spahr | |
| 2,386,759 | A | 10/1945 | Ulm | |
| 2,832,489 | A | 4/1958 | Bailey | |
| 2,941,683 | A | 6/1960 | Fowler | |
| 2,944,689 | A * | 7/1960 | Arnot | 414/607 |
| 2,990,074 | A | 6/1961 | Berquist et al. | |
| 3,007,592 | A | 11/1961 | Adams | |
| 3,207,347 | A | 9/1965 | Ehrlich | |
| 3,229,830 | A | 1/1966 | Smith | |
| 3,396,862 | A | 8/1968 | Fischer | |
| 3,410,432 | A | 12/1968 | Foss et al. | |
| 3,415,339 | A * | 12/1968 | Range | 182/2.7 |
| 3,534,990 | A | 2/1969 | Didtel et al. | |
| 3,587,893 | A | 6/1971 | Laken | |
| 3,674,161 | A | 7/1972 | Grinde | |
| 3,734,319 | A * | 5/1973 | Frisk | 414/686 |
| 3,759,399 | A | 9/1973 | Glass et al. | |
| 3,788,492 | A | 1/1974 | Kraft | |
| 3,851,777 | A | 12/1974 | Dilny | |
| 4,065,013 | A * | 12/1977 | Orthman | 414/607 |
| 4,102,464 | A | 7/1978 | Schuster | |
| 4,230,434 | A | 10/1980 | Seaberg | |
| 4,426,188 | A | 1/1984 | Wolf et al. | |
| 4,488,832 | A | 12/1984 | Kinshofer | |
| 4,568,217 | A | 2/1986 | Forsman et al. | |
| 4,699,565 | A * | 10/1987 | Seaberg | 414/785 |
| 4,850,789 | A * | 7/1989 | Zimmerman | 414/703 |

(Continued)

FOREIGN PATENT DOCUMENTS

| | | |
|---|---|---|
| JP | 54-039873 | 3/1979 |
| JP | 02-175598 A | 7/1990 |
| KR | 10-2009-0076041 | 7/2009 |

*Primary Examiner* — James Keenan
(74) *Attorney, Agent, or Firm* — Price Heneveld LLP

(57) ABSTRACT

A boom apparatus is provided for a fork truck having an elevator frame, a carriage movable via the elevator frame, and fork-supporting transverse members on the carriage. The apparatus includes a boom mount mechanically attached to the transverse members, and a boom mechanically attached to the boom mount. The boom mount includes a vertical plate, and top and bottom braces forming opposing hooks for engaging the transverse members. The top brace also includes a narrow section with horizontal hole that aligns with holes in brackets on the boom. A lock pin extends through the aligned holes to lock the boom to the mount. The mount includes a bottom T pin that fits into a slot at the boom's bottom to secure the boom in a vertical orientation on the mount. By this arrangement, the boom and boom mount can be securely and easily attached to a fork truck without welding.

22 Claims, 8 Drawing Sheets

U.S. PATENT DOCUMENTS 5,033,934 A 7/1991 Emilio
5,145,034 A 9/1992 Miles
5,244,336 A 9/1993 Engler et al.
5,975,831 A * 11/1999 Martin ..... 414/543
6,233,827 B1 5/2001 Oliver et al.
2004/0197178 A1* 10/2004 Osterloh et al. ..... 414/607
2007/0183882 A1* 8/2007 Salazar ..... 414/607
2008/0101907 A1* 5/2008 Hedstrom et al. ..... 414/607

* cited by examiner

DETACHABLE BOOM APPARATUS FOR FORK TRUCKS

BACKGROUND

The present invention relates to a detachable boom that can be quickly and securely attached to a fork truck without welding and without other non-mechanical means.

Fork trucks are useful for lifting heavy objects and sometimes booms are attached to the fork trucks for millwright work, such as for moving heavy machinery. However, for very heavy lifting, safety is a serious concern. There are two common ways in the industry of dealing with this issue. First, many millwrights construct their own device, including welding the boom to the fork truck so that there is no doubt about sureness of the attachment. Then, when done using the apparatus, they cut off the boom to avoid the liability of someone else using their custom-built device. Second, some companies will ship the fork truck to a location where the boom can be welded to the fork truck, and then ship the combined truck-and-boom to the location of use. When done, the process is repeated in order to remove the boom from the fork truck so that the fork truck can be used for other operations. Both of these methods have disadvantages and costs.

There are some known patents that propose booms attachable to fork trucks. However, they apparently do not provide a desired level of durability, strength, ease-of-assembly, ease-of-disassembly, lift capacity, and/or robustness based on their lack of market success and/or lack of market presence.

SUMMARY OF THE PRESENT INVENTION

In one aspect of the present invention, a boom apparatus is provided for a fork truck having a carriage and an elevator frame for lifting the carriage, the carriage including a fork-supporting transverse framework adapted to support a pair of forks at different width dimensions. The boom apparatus includes a detachable boom mount and a boom. The boom mount includes a plate frame with top and bottom first connectors constructed to mechanically securely engage the fork-supporting transverse framework at top and bottom locations and further including vertically-spaced boom-engaging connectors. The boom includes top and bottom second connectors mechanically releasably engaging and secured to the vertically-spaced boom-engaging connectors on the mount.

In another aspect of the present invention, a method of attaching a boom to a fork truck comprises steps of fastening a boom mount to the fork truck, thereafter moving the fork truck horizontally into position against a boom, thereafter lifting the boom mount to engage the boom, and thereafter fastening the boom to the boom mount using fasteners.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
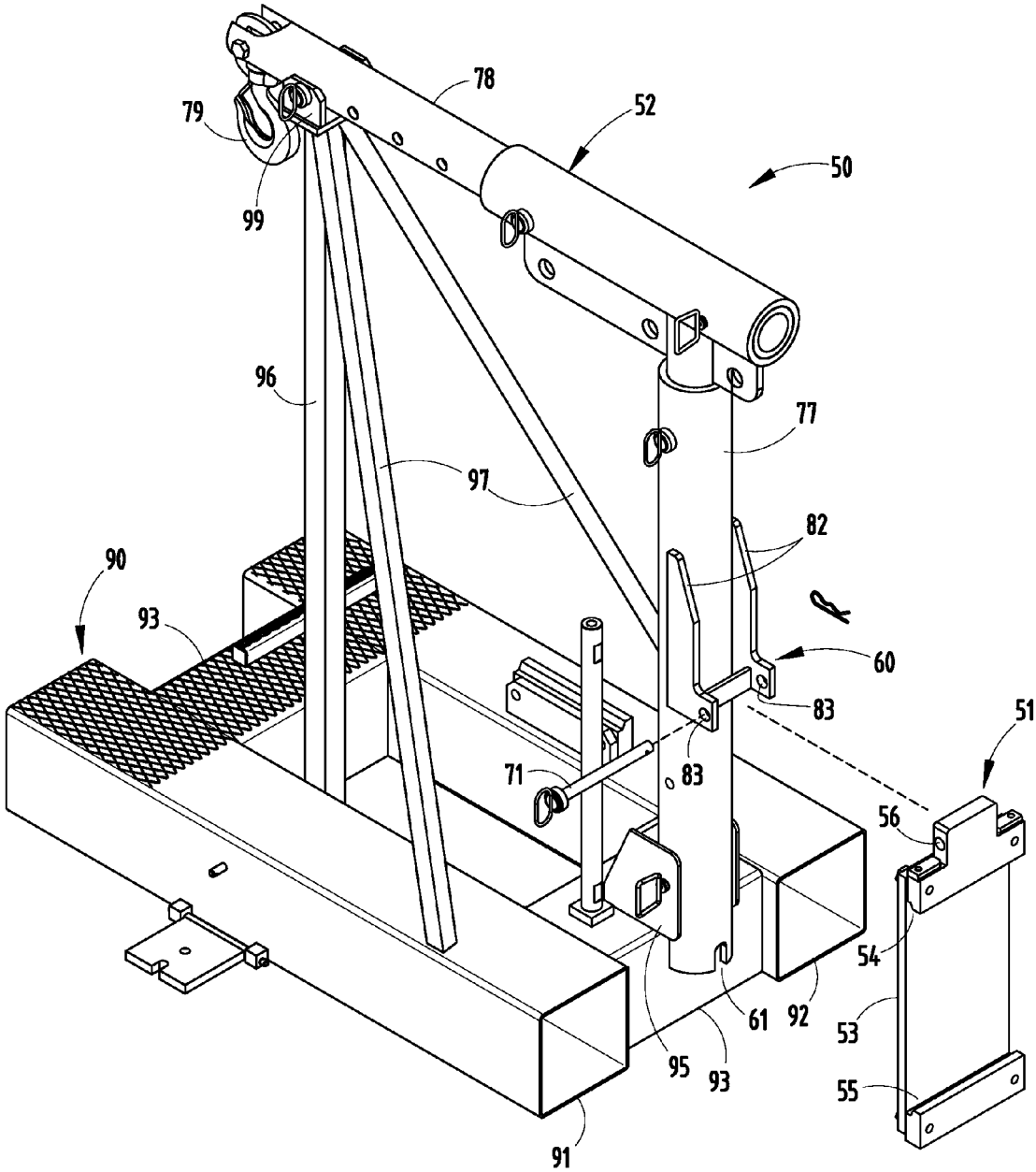
FIGS. 1-2 are a partially exploded and fully exploded perspective view of the present boom apparatus on a holding fixture.
Figure 2:
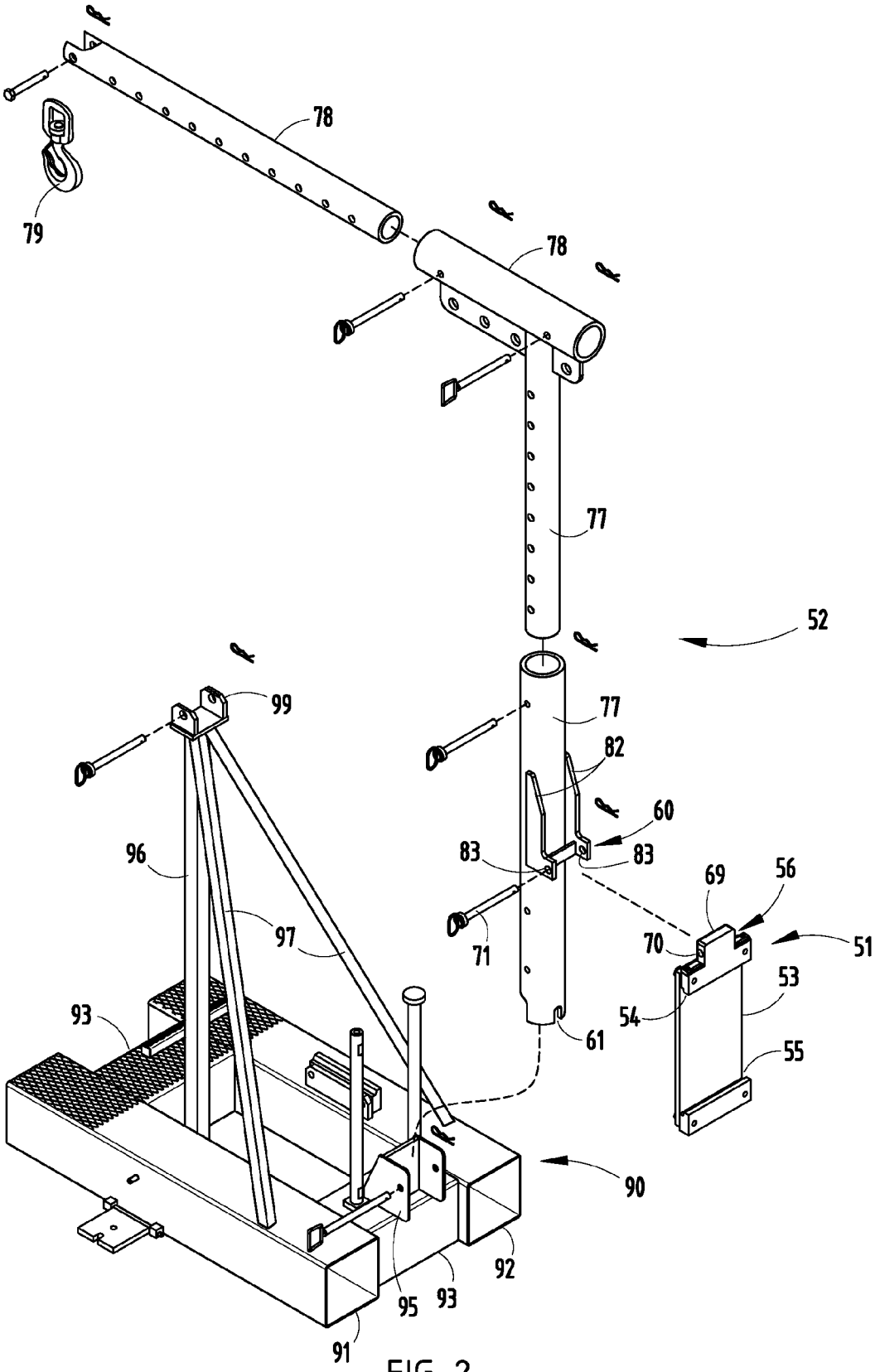

The present boom apparatus 50 (FIGS. 1-2, 6-7) is provided for a fork truck 20 having a carriage 21 and an elevator frame 22 for lifting the carriage 21. The carriage 21 includes a fork-supporting transverse framework (i.e., horizontal carrier bars 23 and 24) adapted to support a pair of forks 25 at different width dimensions. The apparatus 50 includes a detachable boom mount 51 and a boom 52. The boom mount 51 includes a plate frame 53 with top and bottom first connectors 54 and 55 constructed to mechanically securely engage the fork-supporting transverse framework 23, 24 at top and bottom locations between the forks 25. The boom mount 51 further includes vertically-spaced boom-engaging connectors 56 and 57. The boom 52 includes top and bottom second connectors 60 and 61 constructed to mechanically releasably engage and be secured to the vertically-spaced boom-engaging connectors 56 and 57 on the mount 51. The arrangement is constructed to mechanically attach the mount 51 to the fork truck 20 and mechanically attach the boom 52 to the mount 51 with durability, strength, ease-of-assembly, ease-of-disassembly, lift capacity, and robustness. Further, the attachment and disattachment methods are novel, useful, and unobvious over know methods.

Figure 3:
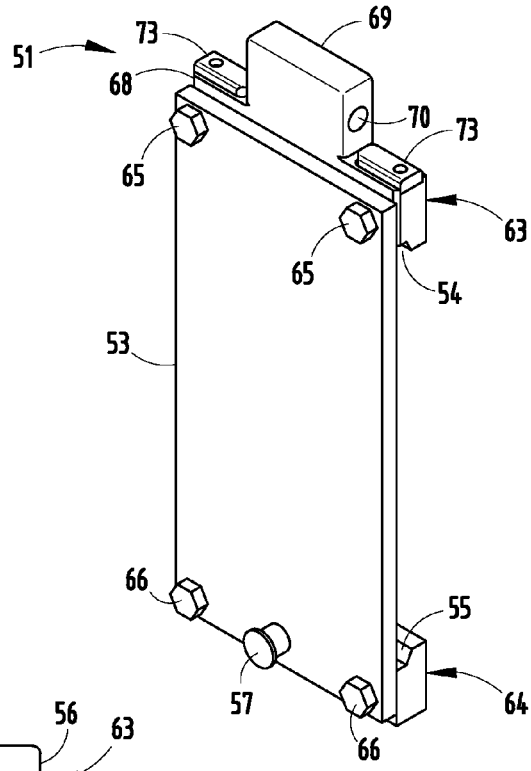
FIGS. 3-5 are perspective, side, and front views of the boom mount in FIG. 1.
Figure 4:
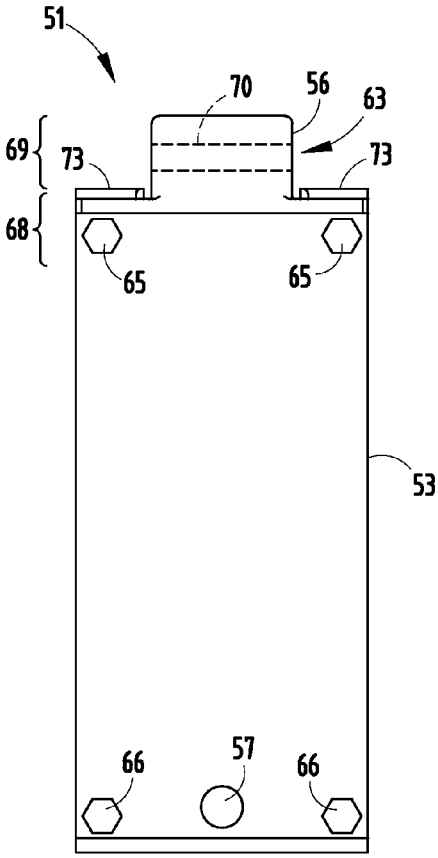
Figure 5:
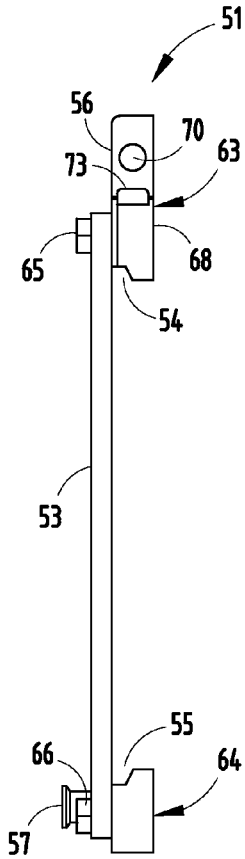
Figure 6:
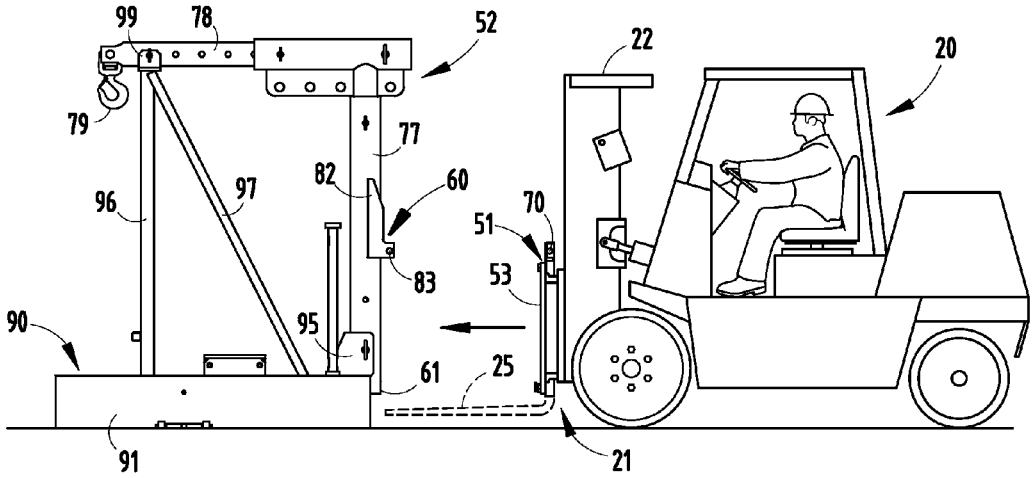
FIGS. 6-7 are side and perspective views of a fork truck approaching the boom apparatus with the boom apparatus supported on a holding fixture.
Figure 7:
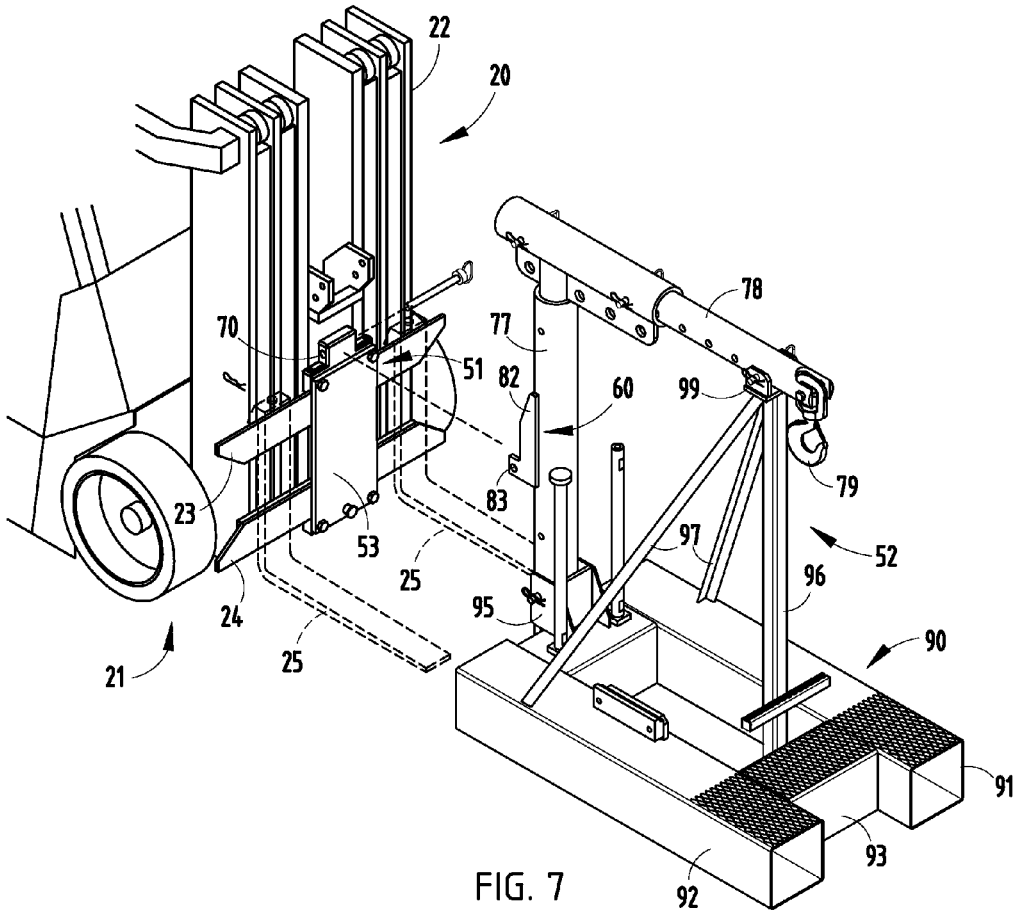
Figure 8:
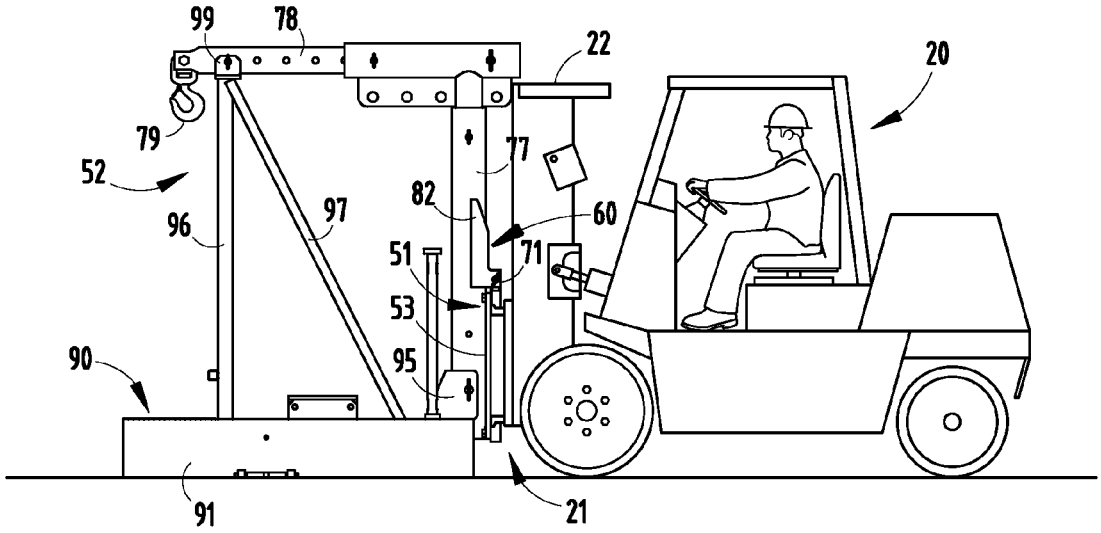
FIGS. 8-9 are side and perspective views of a fork truck engaging the boom apparatus with the boom apparatus ready for lifting off of the holding fixture.
Figure 9:
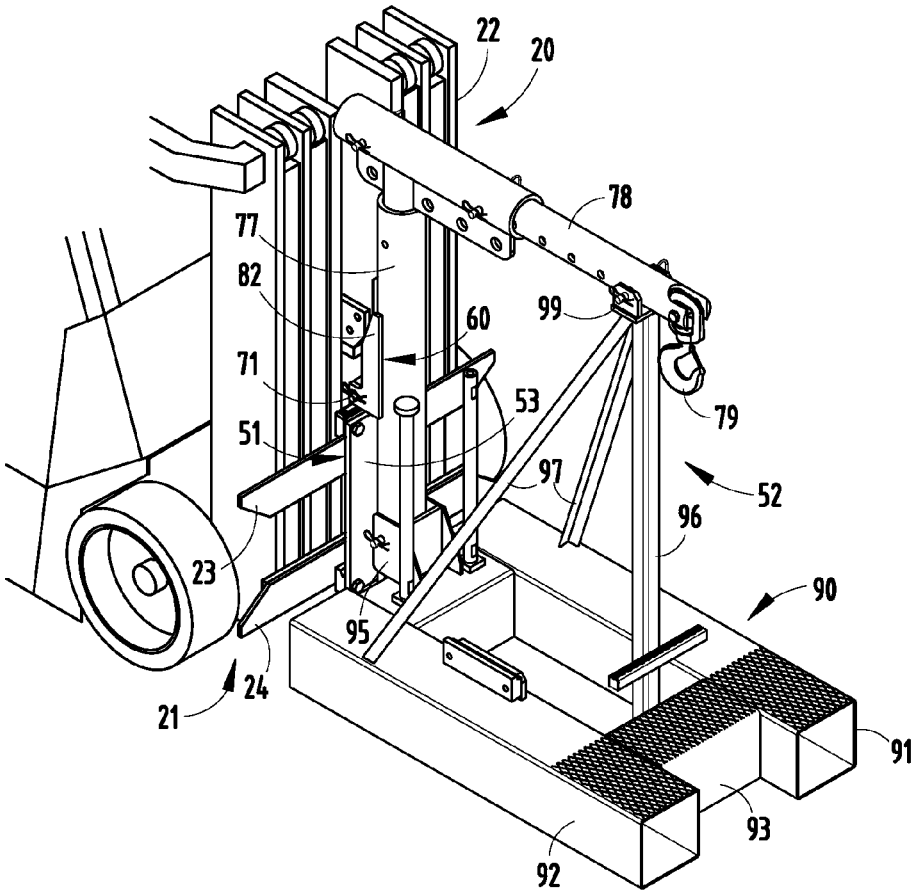
Figure 10:
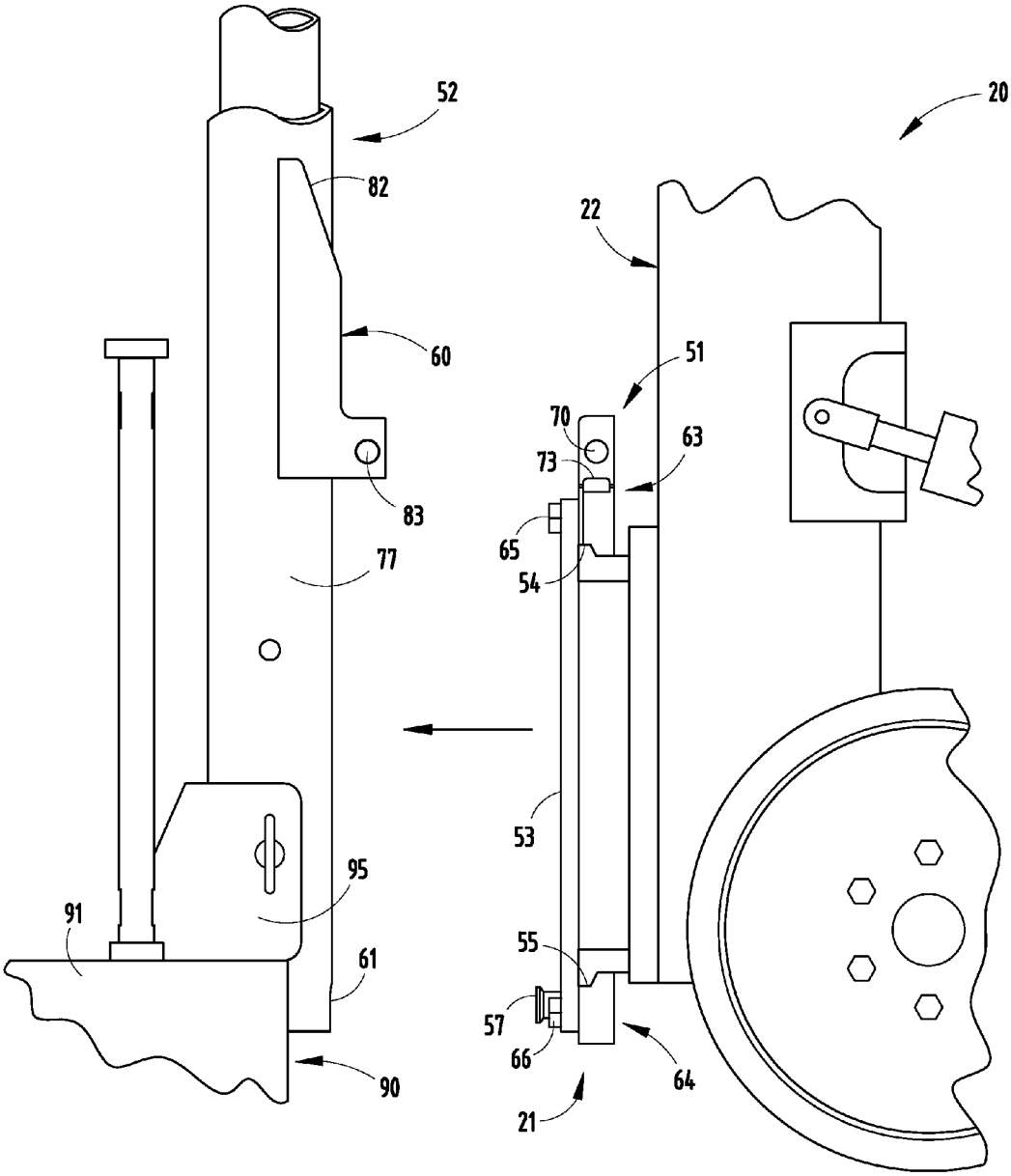
FIG. 10 is an enlargement of the fork truck, boom mount, and boom just prior to engagement.
Figure 11:
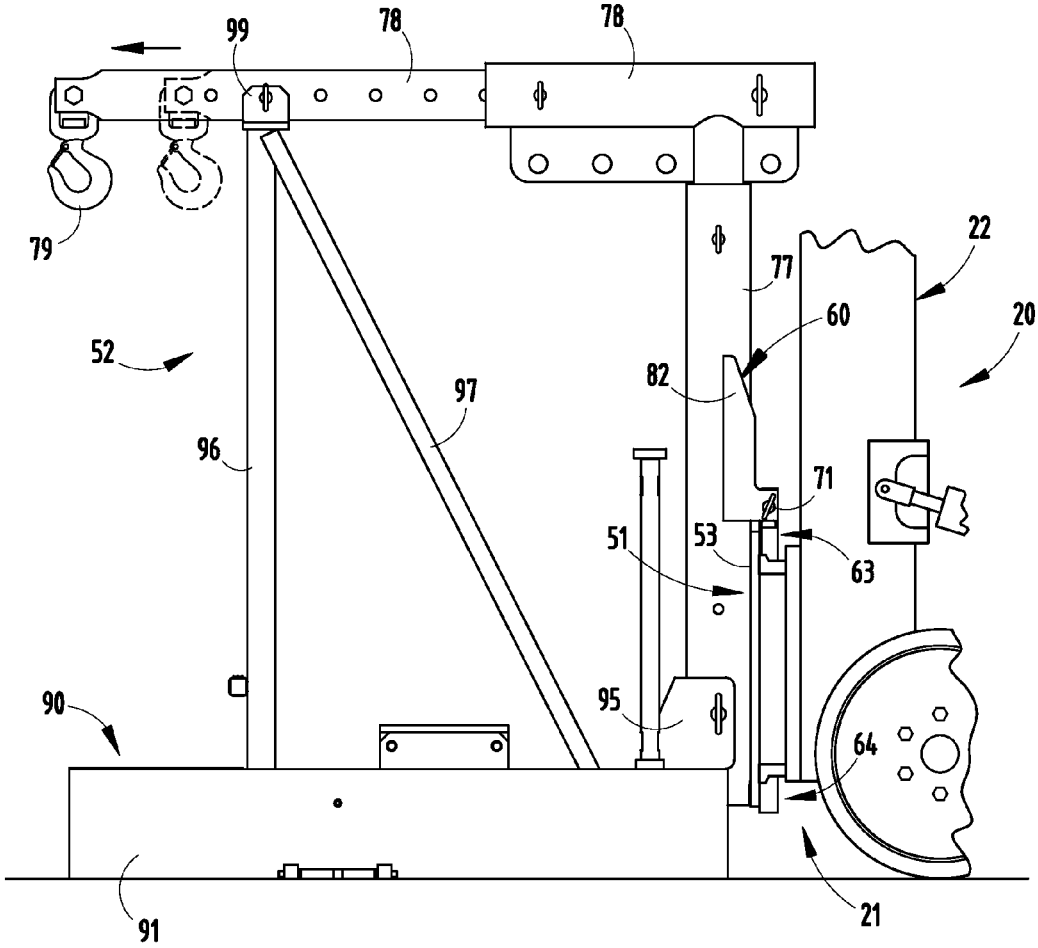
FIG. 11 is an enlarged fragmentary view of FIG. 8, but also showing additional adjustments of the boom.
Figure 12:
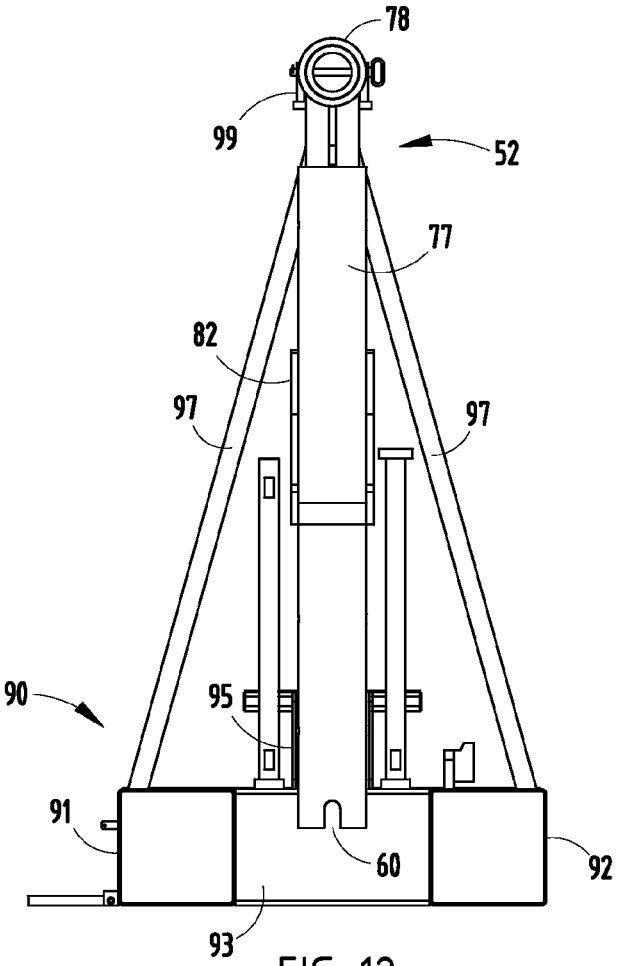
FIGS. 12-13 are front and rear views of the holding fixture in FIG. 1.
Figure 13:
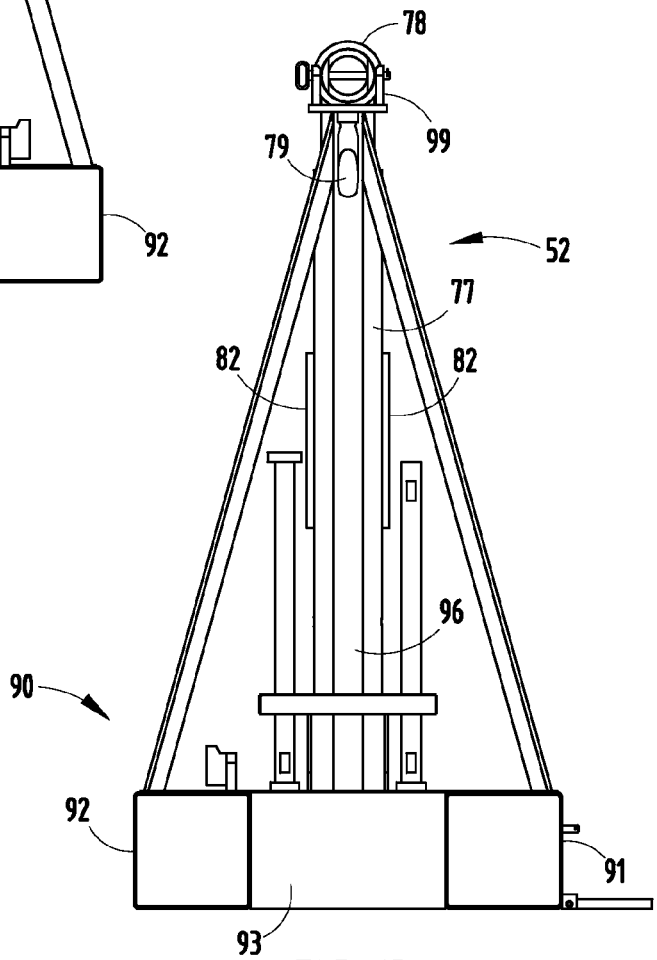

The boom mount 51 (FIGS. 3-5) includes top and bottom horizontally-extending bar-like braces 63 and 64 attached the plate frame 53 by bolts 65 and 66. (The top braces 63 can be welded in place if desired.) The top brace 63 incorporates the first connector 54, which extends rearwardly and is an integrally-formed down-facing hook that extends across a horizontal width of the mount, and that is configured to securely engage a top surface of the top carrier bar 23 of the fork-supporting framework. The top brace 63 has an inverted T shape, in front view, formed by a horizontal section 68 and an upstanding narrow vertical section 69. The vertical section 69 has a transverse hole 70 through it that aligns with holes in the bracket arms 82 discussed later. A locking pin 71 fits through the hole 70 and through aligned holes 83 in the bracket arms 82 to secure the top brace 63 to the boom 52. The locking pin 71 and vertical section 69 form part of the top boom-engaging connector 56. Hardened rest pads 73 are attached atop ends of the horizontal section 68. The rest pads 73 facilitate alignment as the fork truck 20 moves the boom mount 51 into position against the post of the boom 52.

The bottom brace 64 (FIGS. 3-5) includes a solid bar body extending horizontally and incorporates the bottom first connector 55 which is an intergrally-formed up-facing bottom hook shaped to securely engage the bottom carrier bar 24 of the fork-supporting framework. It is noted that the plate frame 53 and braces 63 and 64 fit between forks 25, such that the present apparatus 50 can be attached while the forks 25 are still attached to the fork truck 20.

The boom mount 51 (FIGS. 1-2) further includes the bottom boom-engaging connector 57, which comprises a forwardly-protruding stud (also called an "alignment pin" or "lower rest pin" or "anti-sway pin") that mates with the bottom second connector 61 described below.

The boom 52 includes a vertical post 77 and a horizontal beam 78 with a functional hook 79. The illustrated vertical post 77 is cylindrical, tubular, and incorporates telescopingly extendable tubes, but it is noted that it can be a single tube or square or have another cross-sectional shape, and can include ribs or other means for rigidification. Similarly, the horizontal beam 78 is cylindrical, tubular, and incorporates telescopingly extendable tubes, but it is noted that it can be a single tube or square or have another cross-sectional shape, and can include ribs or other means for rigidification. The functional hook 79 is removable and can be replaced with a hook or other tool adapted for particular jobs.

The top second connector 60 (FIG. 2) includes a pair of bracket arms 82 welded to the post 77 and spaced apart to form a space for matably receiving the narrow vertical section of topbrace 63. The bracket arms 82 include a pair of aligned holes 83 that can be positioned in alignment with the hole 70 in the vertical section 69 of top brace 63 for receiving the locking pin 71. A bottom surface of the bracket arms 82 is positioned to engage the rest pads 73 to help align the holes 70 and 83.

The bottom second connector 61 (FIG. 2) on the boom 52 comprises a downwardly open slot in the vertical post 77. The slot-type second connector 61 is shaped to receive the stem of the stud-shaped bottom boom-engaging connector 57 of the mount 51. Specifically, the connector 61 includes a stem that extends through the slot, and an enlarged head that engages marginal material forming the slot-type connector 61. By this arrangement, the mount 51 can be moved against the post 77, with the stud bottom boom-engaging connector 57 under the slot-type second connector 61 and with the narrow vertical section 69 of the top brace 63 slightly below the bracket arms 82. The mount 51 can then be lifted to slide the bottom stud-like boom-engaging bottom connector 57 into the slot-type second connector 61 and to position the narrow vertical section 69 between the bracket arms 82, with the holes 70 and 83 aligned. Locking pin 71 can then be slid into the holes 70 and 83 and a cotter pin used to secure the pin 71 in place. Thus, the boom 52 is attached to the boom mount 51 on the fork truck 20, and is ready for use. Notably, in this arrangement, the stud connector 57 acts to stabilize the boom 52 on the boom mount 51 against sway, yet stress is primarily carried by the upper connectors 54 and 56/60.

The method just described includes mechanically/removably fastening a boom mount to the fork truck; thereafter, moving the fork truck horizontally into position against a boom; thereafter, lifting the boom mount to engage the boom; and thereafter mechanically fastening the boom to the boom mount. This includes in the step of fastening boom to mount, an action step where the stud is moved under the slot-like connector, and then after lifting, putting in the horizontal locking pin to secure the assembly.

Testing shows that the present arrangement is very stable and able to carry substantial loads. For example, where the stress carrying components of the fork truck 20, mount 51 and boom 52 are sufficient in size, loads of over 7500 pounds can be carried at 6 feet from the front of the fork truck 20. In the present example, the post 77 is made of A519and is about 7 inches in diameter. Also, the beam 78 is made of A519and is about 5.5 inches in diameter. The plate frame 53 is made of A36 and is 30 inches high, 14 inches wide, and 1 inch thick. The upper brace 63 is made of A36 and is 8 inches high, 19 inches wide, and 2 inches thick, with the hook defining a cavity shaped to closely engage the mating shape of the fork-supporting framework bar 23. The lower brace 64 is made of A36 and is 4 inches high, 14 inches wide, and 2 inches thick, with the hook defining a cavity shaped to closely engage the mating shape of the fork-supporting framework bar 24. The stud bottom connector 57 on the mount 51 is made of A36 and includes a stem diameter of about 1½ inches and a head diameter of about 2 inches. The slot connector 61 on the boom 52 includes a size and shape to matably receive the stud bottom connector 57, and has a length of about 2 inches.

The boom 52 can be placed in a holder 90 (also called a holding fixture) (FIGS. 1-2, 12-13) when not in use. The holder 90 includes a pair of parallel side tubes 91 and 92 for receiving the forks 25 of the fork truck 20 (so that the forks 25 do not have to be removed when attaching the boom to the fork truck 20). Transverse tubes 93 are welded to the side tubes 91 and 92 to secure them in spaced relation. A short up-tube section or box section 95 is welded to the assembly in a position for receiving a bottom of the post 77 of the boom 52. A vertical support 96 is welded to the assembly with a top hand 99 on the support 96 located to support an outer end of the horizontal beam 78 of the boom 52. Angled braces 97 are provided for fixing and stablizing the vertical support 96. By this arrangement, the boom 52 is held in an upright position with the connectors 60 and 61 ready for "straight-on" engagement by the fork-truck-mounted mount 51.

It is contemplated that the plates 53, 54 and 55 can be used to connect a variety of attachments to fork trucks, skid steers, skytracks, tractors, and any other industrial, construction or agriculture implements with lifting capabilities. Some examples of the attachments are as follows, but not limited to, drum lifters, trailer spotters and pipe lifters.

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. A boom apparatus for a fork truck having a carriage and an elevator frame for lifting the carriage, the carriage including a fork-supporting transverse framework adapted to support a pair of forks at different width dimensions, the apparatus comprising:

a detachable boom mount including a plate frame with top and bottom first connectors constructed to mechanically securely engage the fork-supporting transverse framework at top and bottom locations and further including vertically-spaced boom-engaging connectors, the detachable boom mount including a single top brace secured to the plate frame that defines both the top first connector and a top one of the vertically-spaced boom-engaging connectors; and a boom including top and bottom second connectors mechanically releasably engaging and secured to the vertically-spaced boom-engaging connectors on the mount.

2. The apparatus of claim 1, wherein the boom mount includes a single bottom horizontally-extending brace attached to the plate frame that incorporates a bottom one of the vertically-spaced boom-engaging connectors.

3. The apparatus of claim 2, wherein the top brace includes a solid bar body having a horizontal section forming a top hook which is down-facing, and having an upstanding narrow vertical section incorporating the top second connector.

4. The apparatus of claim 3, wherein the bottom brace includes a second solid body with a horizontal section forming a bottom hook which is up-facing.

5. The apparatus of claim 4, wherein a bottom one of the boom-engaging connectors includes a forwardly-protruding stud that mates with the bottom second connector.

6. The apparatus of claim 5, wherein the top second connector includes bracket arms that form a space receiving the top boom-engaging connector.

7. The apparatus of claim 6, wherein the narrow vertical section has a first hole forming part of the top first connector, wherein the bracket arms include additional holes that align with the first hole, and including a locking pin that fits through the first and additional holes.

8. The apparatus of claim 1, wherein the first connectors include opposite vertically-facing hooks adapted to engage top and bottom surfaces, respectively, of the transverse framework.

9. The apparatus of claim 1, wherein the top second connector includes bracket arms that form a space receiving the top first connector.

10. The apparatus of claim 9, wherein the mount includes a top brace with a narrow vertical section having holes forming part of the top first connector.

11. The apparatus of claim 10, wherein the bracket arms include a pair of aligned horizontal holes forming part of the top second connector, and that align with a mating hole in the narrow vertical section, and including a locking pin shaped to fit through the aligned horizontal holes and the mating hole for interconnection.

12. The apparatus of claim 11, wherein the bottom boom-engaging connector comprises a stud, and wherein the bottom second connector comprises a slot shaped to receive the stud.

13. The apparatus of claim 12, wherein the boom includes a single vertical post and a horizontal beam, the post being tubular and incorporating the slot which opens to a bottom of the post.

14. The apparatus of claim 13, wherein the mount includes rest pads located on a top of the mount for engagement with the bracket arms to facilitate alignment and attachment of the boom to the boom mount.

15. The boom apparatus defined in claim 1, wherein the single top brace is T-shaped, and includes an upwardly protruding portion.

16. The boom apparatus defined in claim 1, wherein the single top brace includes an upwardly protruding portion that extends above a top of the plate frame.

17. The boom apparatus defined in claim 1, wherein the single top brace is bolted to the plate frame and does not include welded material for attachment.

18. A method of attaching a boom to a fork truck, comprising steps of:

fastening a boom mount to the fork truck, the boom mount including a plate frame with top and bottom first connectors constructed to mechanically securely engage a fork-supporting transverse framework of a fork truck at top and bottom locations and further including vertically-spaced boom-engaging connectors, the boom mount including a single top brace secured to the plate frame that defines both the top first connector and a top one of the vertically-spaced boom-engaging connectors;

thereafter, moving the fork truck horizontally into position against a boom, the boom including top and bottom second connectors;

thereafter, lifting the boom mount to engage the boom including mechanically releasably engaging at least one of the vertically-spaced boom-engaging connectors on the mount; and thereafter fastening the boom to the boom mount.

19. The method defined in claim 18, wherein the bottom first connector includes a stud and a bottom one of the boom-engaging connectors includes a slot, and wherein the step of fastening the boom to the boom mount includes moving the stud under the slot, and then after lifting, putting a horizontal locking pin into aligned holes to secure an upper portion of the boom to a top of the boom mount.

20. A boom apparatus for a fork truck having a carriage and an elevator frame for lifting the carriage, the carriage including a fork-supporting transverse framework adapted to support a pair of forks at different width dimensions, the apparatus comprising:

a detachable boom mount including a plate frame with top and bottom first connectors constructed to mechanically securely engage the fork-supporting transverse framework at top and bottom locations and further including vertically-spaced boom-engaging connectors, the detachable boom mount including a single brace forming a top one of the vertically-spaced boom-engaging connectors and a single stud forming a bottom one of the vertically-spaced boom-engaging connectors; and a boom including top and bottom second connectors mechanically releasably engaging and secured to the vertically-spaced boom-engaging connectors on the mount, the top second connector including a pair of bracket arms spaced to engage opposing sides of the single brace, and the bottom second connector including a notch engaging the single stud.

21. A method of attaching a boom to a fork truck, comprising steps of:

fastening a boom mount to the fork truck, the boom mount including a plate frame with top and bottom first connectors constructed to mechanically securely engage a fork-supporting transverse framework of a fork truck at top and bottom locations and further including vertically-spaced boom-engaging connectors, the boom mount including a top brace secured to the plate frame that defines the top first connector and a single stud forming a bottom one of the vertically-spaced boom-engaging connectors;

thereafter, moving the fork truck horizontally into position against a boom, the boom including top and bottom second connectors, the bottom second connectors including a down-facing notch;

thereafter, lifting the boom mount to engage the boom including mechanically releasably engaging the stud and notch; and thereafter fastening the boom to the boom mount using a pin to engage the top first connector and a top one of the second connectors.

22. A boom apparatus for a fork truck having a carriage and an elevator frame for lifting the carriage, the carriage including a fork-supporting transverse framework adapted to support a pair of forks at different width dimensions, the apparatus comprising:

a detachable boom mount including a plate frame with top and bottom first connectors constructed to mechanically securely engage the fork-supporting transverse framework at top and bottom locations and further including vertically-spaced top and bottom boom-engaging connectors; and a boom including top and bottom second connectors mechanically releasably engaging and secured to the vertically-spaced top and bottom boom-engaging connectors on the mount;

one of the bottom second connectors and the bottom boom-engaging connectors including a notch and the other of the bottom second connectors and the bottom boom-engaging connectors including a stud engaging the notch for connecting a bottom of the boom to the boom mount.

* * * * *